United States Patent [19]

Logvinov et al.

[11] Patent Number: 4,458,743

[45] Date of Patent: Jul. 10, 1984

[54] CASTING MOLD FOR CASTING BY SQUEEZING

[76] Inventors: Anatoly A. Logvinov, 7-ya Parkovaya, 27, kv. 52; Vladimir N. Milov, Krivorozhskaya, 21, korpus 2, kv. 67; Nikolai S. Ostrenko, ulitsa Kosinskaya, 26, korpus 1, kv. 64; Nikolai A. Demyanovich, 1-y Goncharny pereulok, 7, kv. 108, all of Moscow, U.S.S.R.

[21] Appl. No.: 371,184

[22] Filed: Apr. 23, 1982

[51] Int. Cl.[3] ..... B22D 17/26; B22D 33/04

[52] U.S. Cl. ..... 164/342; 164/137

[58] Field of Search ..... 164/113, 120, 284, 302, 164/340, 342, 137

[56] References Cited

FOREIGN PATENT DOCUMENTS 20274 7/1970 Japan .
617164 7/1978 U.S.S.R. .

*Primary Examiner*—Kuang Y. Lin
*Assistant Examiner*—Jerold L. Johnson
*Attorney, Agent, or Firm*—Murray Schaffer

[57] ABSTRACT

A set of half molds mounted so that they are movable on a base and when drawn together, form a split mold which can be taken apart upon separation, the half molds have spaces which form slit gates communicating with a metal receiver and the central cavity of the half molds, whose surfaces form the surfaces of the casting. At least one of the side surfaces of the slit gate-forming spaces is made step-shaped in the direction of molten metal level so that upon the drawing together of the half molds, the accuracy in raising the level of the molten metal may be enhanced.

7 Claims, 10 Drawing Figures

CASTING MOLD FOR CASTING BY SQUEEZING

BACKGROUND OF THE INVENTION

The present invention relates to metallurgy and, more particularly, it relates to foundry apparatus, namely, to casting molds for casting by squeezing, particularly for the casting of large size thin-walled objects having an intricate form, such as a space casings and panels with ribbing and local bosses. The present invention can be most extensively used in the manufacture of very critical parts, mainly in aircraft, which should be manufactured from a cast material of stable and high quality.

In the last decade, the so-called method of casting by squeezing has found extensive application for producing large-size thin-walled (2–5 mm) castings whose thickness corresponds to that of the finished part. This method involves a synchronous drawing together of half molds, forming a split mold, to ensure the displacement from the bottom zone of the mold or metal receiver cavity of a greater part of liquid metal, poured therein, into the top zone of a communicating cavity in the center of which the casting proper is formed while at the edges, in places of separation of the half molds, flat slit gates are formed communicating with the body of the casting.

The rate of the metal level rise in the mold is an important parameter of the casting process, and is responsible for quality crystallization of metal in the mold upon the drawing together of the half molds and, as a result, for the high quality of the material of the thus produced casting. The rate at all of the stages of the formation of casting should not exceed a given critical value depending upon a number of factors, including the type of metal and initial temperature thereof. In order to ensure the optimum rate of the rise of the metal level in the mold, the half molds are drawn together at a variable rate which, in turn, depends upon the variation of the mold cavity cross-section.

For casting by squeezing, use is made of casting molds having a base with a core centrally mounted thereon, the outer surface of the core corresponding to the inner surface of the blank. The half molds are also mounted on the base with the ability to move towards each other so as to be drawn together to form the mold and subsequently for being drawn apart to effect the splitting of the mold. The working or inner surfaces of the half molds correspond to the outer contours of the casting being formed. The surface of the base and of the bottom portion of the half molds form a metal receiver into which a batch of liquid metal is poured from which to form the casting. The gaps between the half molds are closed over their periphery in the mold splitting zone, prior to pouring the metal into the metal receiver and during the time of forming a casting, with compression cheeks stationarily mounted or movable together with one of the half molds. These gaps serve as the slit gates of the mold (cf., V. N. Vinogradov, Liteiniye formy dlia tsvetnykh splavov—Casting Molds for Non-Ferrous Alloys, Mashinostroiyeniye Publishers, Moscow, 1981, pp. 35, 37).

When using such half molds in a machine for casting by squeezing, the base of a split casting mold is secured on the central portion of the machine frame, while there is mounted at the edges of the frame posts with plates to which the half molds are securely attached and which are capable of moving with the aid of individual drives for drawing apart and splitting the mold. For example, in the case of a hydraulic drive for moving the plates, which is used most frequently in machines of this type, the latter are provided with means for synchronization of the movement of the plates and programmable adjustment of their rate of movement. The rate of movement of the plates is varied by varying the flow section of pipelines supplying said drives, by way of directional control from followers over the position of special throttle units built in the pipelines. The working profile of such followers is calculated or selected empirically such as to ensure a specific mode of half mold movement to make up a split mold for forming a specific casting only. The presence of intermediate links in the follower-throttle unit-drive-plate system results in some deviation from the preset mode of the half mold movement in the course of forming a casting. Such deviation is further aggravated by the fact that the follower profile cannot be given a shape that would ideally satisfy the condition of ensuring the rated mode of half mold movement with abrupt and substantial angular variations of casting profile portions since the conditions of force interaction of the follower with the element transmitting the control displacement to the slide valve of the throttle unit define the maximum permissible direction angle of the follower profile which should not exceed the pressure angle for the transmitting mechanism, which angle normally does not exceed 45°. The afore-listed problems affect the maintance of the accuracy of the mode of half mold movement and is characterized by a relatively stable nature are complemented with those of an unstable nature for which it is relatively difficult or just impossible to introduce timely corrections in devices presetting the mode of movement. Such complementary problems include, for instance, variations in the viscosity of the working fluid in the hydraulic system of the machine in the course in the operation causing some variation of dynamic characteristics of the power drive; the instability of variation of the viscosity of metal in the mold cavity in the course of forming a casting. In addition some instability of the values of cross-sectional area of the mold cavity occurs between the half molds being drawn together at one and the same value of the mold stroke and at one and the same level, due to the instability of thickness of refractory coating applied to the half mold surfaces forming the casting periodically after pouring the metal or after a cycle of such pourings.

As a result, passive control over the mode of movement of half molds by their drives in the course of forming a casting for maintaining optimal rate of the use of metal surface level in the mold using a follower alone, as practiced in prior art machines, brings about a situation where the rate of the rise of metal surface level in the mold cavity differs in most cases from the rated one and, in some portions of the casting where such rate exceeds the maximum permissible one, there is observed a marked deterioration of the quality of cast metal manifested as a sharp violation of the homogeneity of the structure, poorer mechanical properties of the material in such portions, increased surface roughness and porosity, emergence of cavities, microcracks etc.

It is an object of the present invention to develop a split casting mold for use in a casting machine having an adjustable drive for moving the plates, wherein the half molds would be provided with the possibility of affecting the metal at preselected levels of the mold while ensuring local correction of the rate of said metal level rise.

It is another object of this invention to develop a casting mold that would ensure an improved rate of the rise of level of metal in the mold.

Other objects of the present invention include ensuring with the mold of the invention a high stability of the mode of forming the portion of casting which actually represents the cast blank of a part, as well as ensuring an improved quality of cast metal of such a cast blank and a high stability of such improved quality over the blank length and in different blanks.

SUMMARY OF THE PRESENT INVENTION

These and other objects of the present invention are attained by providing a mold for casting by squeezing, fashioned as a split mold defining a set of half molds having, in the plane of their separation, spaces which form slit gates communicating with a metal receiver, the improvement wherein at least one of half mold surfaces, forming a slit gate, is made step-shaped in the direction of the metal level rise.

Such a casting mold is advantageous in that, due to the provision of said step-shaped surface, it is possible to attain the optimum conditions of the liquid metal level rise in the mold cavity, corresponding to the rated conditions thus ensuring the production of long-sized cast blanks featuring a high quality of the casting material.

In one of the embodiments of the present invention, the step-shaped surface is made such that the slit gate it forms expands gradually in the upward direction.

It is such a shape of the step-shaped surface which is preferred, this being due to the need for decelerating the rate of movement of the metal surface during the period when the metal moves in the mold cavity having casting-forming surfaces spaced from each other through a distance close to the wall thickness of a finished blank and when the control action upon the power drive of the machine is ineffective due to short stroke of the half molds.

According to another embodiment of the invention, the step-shaped surfaces in the top portion of a slit gate which is generally expanding upwards can have at some area a gradual narrowing in the direction of the metal level rise.

In the case of a mold characterized by a relatively substantial increase of its cross-sectional area from the bottom to its top, it is possible that the slit gate surface may be step-shaped featuring only a gradual narrowing of said space in the direction of the metal level rise.

The present invention further provides for the possibility of the surfaces of peripheral spaces of both half molds, forming a single slit gate, being made step-shaped, with ledges arranged symmetrically to each other relative to the plane of split. This makes for an increased effect of control action upon the rate of the metal level rise in the mold.

It is preferable that in the plane of slit gate each ledge of the step-shaped surface there is located, with respect to height, in the region over which the cross-section of the resulting casting varies. This helps attain good results in the local control over the rate of rise of the metal surface level in the mold cavity.

It is further expedient, with a view to precluding an abrupt jump in the rate of the metal level rise in a local region of the mold cavity upon transition of the metal from one element of the step-shaped surface to another, that the steps of said surface be inclined.

It is also expedient, with a view to actively affecting the liquid metal rising in the mold at local areas and, thereby, adjusting the rise of metal in that area with due regard for the variation of the rate of such rise, that the step-shaped surfaces be fashioned as a plurality of stationary parts, each having a ledge and a step, and a plurality of parts also made in the form of a ledge and a step, said latter parts alternating with the stationary parts and mounted so as to be movable perpendicularly to the plane of separation of the half molds.

Each one of the moving parts may have its individual drive.

In the preferred, however more sophisticated, embodiment of the casting mold with moving elements of the step-shaped surface of the slit gate, metal level gages are placed in the plane of split near the plane of ledge of the moving step-shaped part, said gages being coupled via feedback circuit to the afore-mentioned individual drives for displacing the moving parts.

The advantage of said embodiment of the casting mold resides in the maximum control effect upon the rate of the metal surface rise depending upon the currently existing level of metal, a high stability in the optimum preset range over the entire height of the mold, as well as in a fully automatic operation of mold elements controlling the process of adjusting the rate of metal level rise.

The present invention will be better understood upon considering the following detailed description of exemplary embodiments thereof, with due reference to the accompanying drawings.

DESCRIPTION OF THE INVENTION

Figure 1:
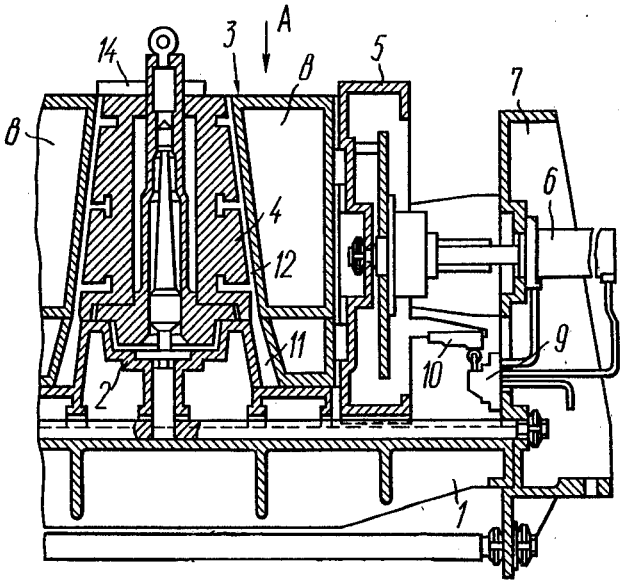
FIG. 1 is a longitudinal section of the casting mold according to the invention, in which no liquid metal has been poured, together with a part of a casting machine on which the mold is mounted, in the position corresponding to the moment of completing the formation of a casting.
Figure 2:
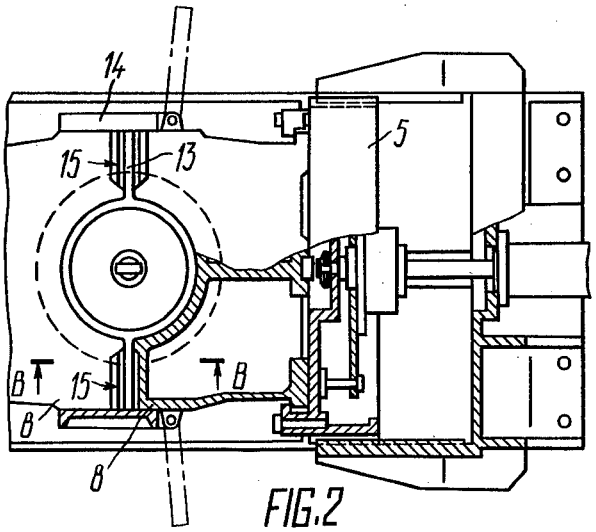
FIG. 2 is a plan view taken in the direction arrow A of the casting mold according to FIG. 1, in partial section, the slit gate surface of the simplest shape, according to the invention.
Figure 4:
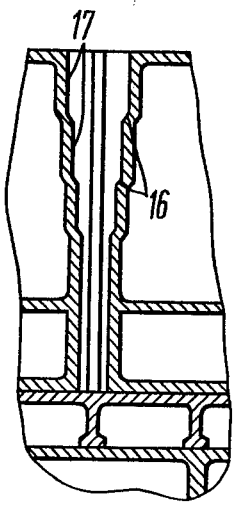
FIGS. 3 to 7 correspond to a section taken over a vertical plane shown at B—B in FIG. 2 and illustrate the various possible embodiments of mold surfaces defining the slit gate space in the casting mold according to FIGS. 1 and 2.
Figure 5:
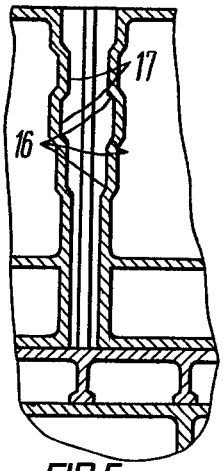
Figure 6:
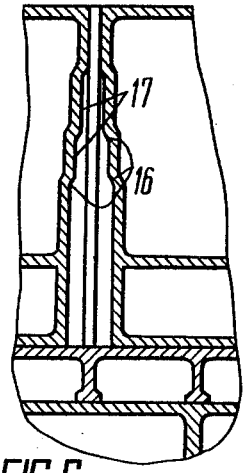
Figure 3:
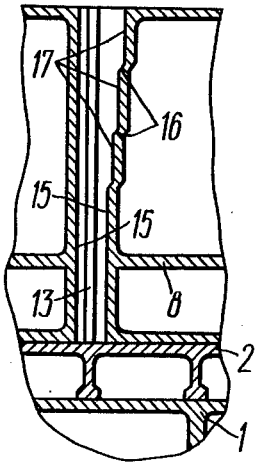
Figure 7:
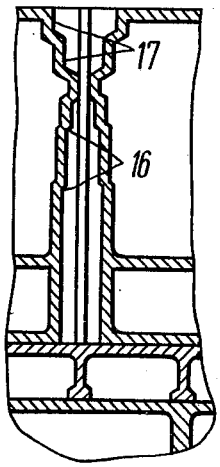

Let us now consider the various embodiments of the herein disclosed casting mold, according to the present invention, and the principle of its operation, as well as of the operation of individual mold elements functioning in the course of forming a casting autonomously or in conjunction with the working members of a machine for casting by squeezing. Since the operation of the mold cannot be readily understood in separation from that of the casting machine, the mold operation will be described in conjunction with some elements of the casting machine, which elements are known in the art and having no direct bearing upon the subject matter of the present invention, and, therefore, are not described in detail so as not to obscure the subject matter of the invention.

Referring now to FIGS. 1 through 7 of the accompanying drawings, these illustrate the simplest embodiment of the mold according to the invention mounted on a machine for casting by squeezing wherein plates are drawn together in a plane-parallel relationship in the position corresponding to the moment of termination of the forming of casting, with FIGS. 3 to 7 illustrating the various embodiments of slit gate surfaces.

Secured on a frame 1 of the machine for casting by squeezing in the central zone thereof is a base 2 of a split casting mold 3 on whose centering pin there may be mounted a core 4. Attached to each plate 5 of the machine, movable by its displacement drive 6 relative to a respective stationary post 7 at the end of the machine frame 1 is one of a pair of half molds 8 of the split mold 3. Each half mold 8 rests with its bottom plane against the base 2 and is capable of moving towards the center of the latter and away from it in a radial direction.

A throttle device 9 controlled over the path of movement of the half molds 8 by means of a programming follower 10 secured on the plate 5 is built in the supply circuit of the displacement drive 6. The half molds 8 and the base 2 with the core 4 form in the base zone a metal-receiving cavity 11. This cavity in the center zone communicates with the working portion of a forming cavity 12 wherein a cast blank is formed and with spaces 13 extending over the plane of separation of the half molds 8. These spaces 13 serve as slit gates of the casting. The spaces 13 are closed, on the outside of the half molds, with compression cheeks 14. Over a certain portion in the top zone of the space 13, a side surface 15 of the half mold 8 is made step-shaped in the form of separate steps 16 and ledges 17. The stepped shape can be imparted simultaneously to the side surface 15 of the outer half mold 8, said latter surface forming together with the former side surface 15 a slit gate (cf., FIG. 4). The level defining the position of the step 16 with respect to the mold height corresponds to the spot showing a sharp variation of the horizontal cross-sectional area of the mold cavity. The nature of variation of the cross-sectional area of the mold cavity 12 with respect to height determines accordingly the direction of convergence of the steps relative to the axial plane of the mold: gradual divergence towards the top of the mold (of., FIG. 4), the presence of converging portions (FIG. 5) or even gradual convergence towards the top of the mold (cf., FIG. 6) or, finally, the presence of diverging and converging portions (cf., FIG. 7). In so doing, individual steps 16 in the space 13 are positioned at an inclination to the horizontal plane.

The herein described embodiments of the casting mold according to the invention operate in the following manner.

Metal is poured into the metal-receiving cavity 11 of the half molds 8 drawn apart through some distance sufficient for the introduction of a batch of liquid metal. The half molds have the core 4 mounted thereinside on the base 2 and the cheeks 14 set in position. For casting such parts as large-size panels the core is not mounted. After pouring of the metal, the drives 6 are used for synchronously drawing together the plates 5 with the half molds 8 towards the axis of the core 4 according to a certain law preset by the follower 10. On being squeezed out of the metal-receiving cavity 11, the metal fills up the forming working cavity 12 and, at the same time, the slit gate space 13. Upon rising, the metal interacts with the steps 16 and ledges 17 of the side surface 15 of the space 13 and, at pre-selected levels, is re-distributed, in accordance with the total area of the steps 16 overlapping the cross-section of said space 13, between the forming mold cavity 12 and slit gate space 13. Due to this, there takes place a re-adjustment (fine adjustment) of the rate of metal level rise in the mold.

Figure 8:
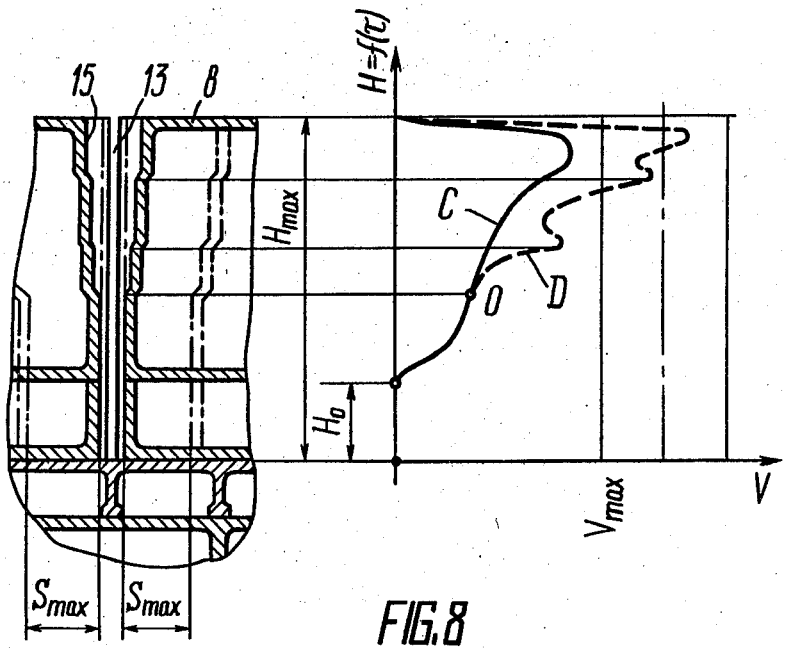
FIG. 8 shows the dependence of the rate of the metal level rise in the mold upon the configuration of the surface of the slit gate space over the height of said slit gate.

This phenomenon becomes apparent upon considering FIG. 8. The left-hand portion of FIG. 8 contains a vertical sectional view of drawn-together half molds and slit gate for the casting featuring several sharp changes in its cross-section at the levels of gate ledges, while the right-hand portion of the Figure presents the graph of the variation of the rate of metal level rise in the mold upon forming a casting for the case of a gate with flat walls (curve D) and of the variation of said rate for the case of a gate with step-shaped surface (curve C).

It is clearly seen from FIG. 8 that the rate V of metal level rise varies in the course of movement of each mold 8 from the initial position shown by dashed line through a stroke $S_{max}$ required for the rise of liquid metal in the mold cavity from the initial level $H_o$ to the final level $H_{max}$, which is necessary for fully forming the casting. Starting with point O, the law of variation of the rate of metal level rise in the mold, present by the follower (not shown in the drawing) for the case of a gate with plane surfaces (curve D), is superimposed by the effect of step-shaped surfaces 15 of the slit gate space 13, and the subsequent variation of the rate of metal level rise in the mold takes place according to the law corresponding to curve C, without exceeding the limiting permissible value of the rate $V_{max}$.

Following the forming of the casting and its solidification, the half molds 8 are drawn apart by the displacement drives 6 to extreme initial positions. With the compression cheeks 14 thrown back, a finished casting is extracted from the mold cavity together with the core for the removal of molding sand and separation of the portion presenting the cast blank of the part proper.

Thus, the afore-described embodiment of the invention provides for the preparation of a casting mold while improving the rate of filling the mold cavity when forming a casting.

Figure 9:
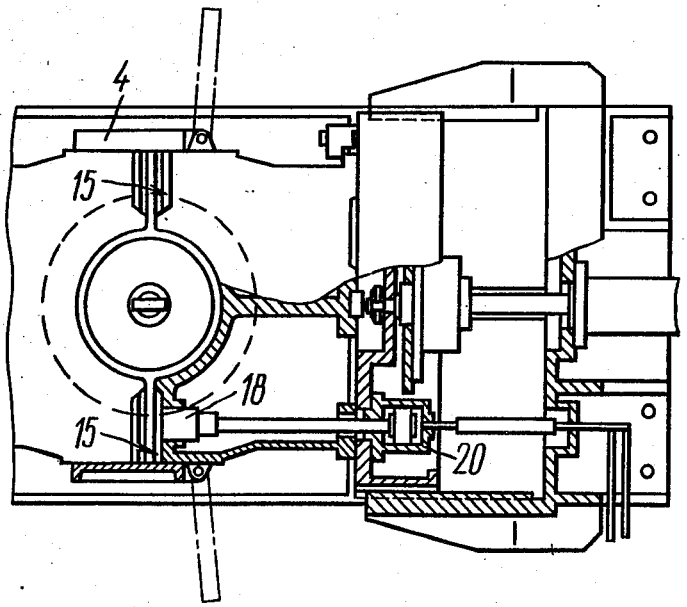
FIG. 9 is a view taken along arrow A of the casting mold according to FIG. 1, analogous to that shown in FIG. 2, but featuring another embodiment of slit gate surfaces in the casting mold, according to the invention, i.e., for the case of surfaces with moving parts of the step-shaped side surface.
Figure 10:
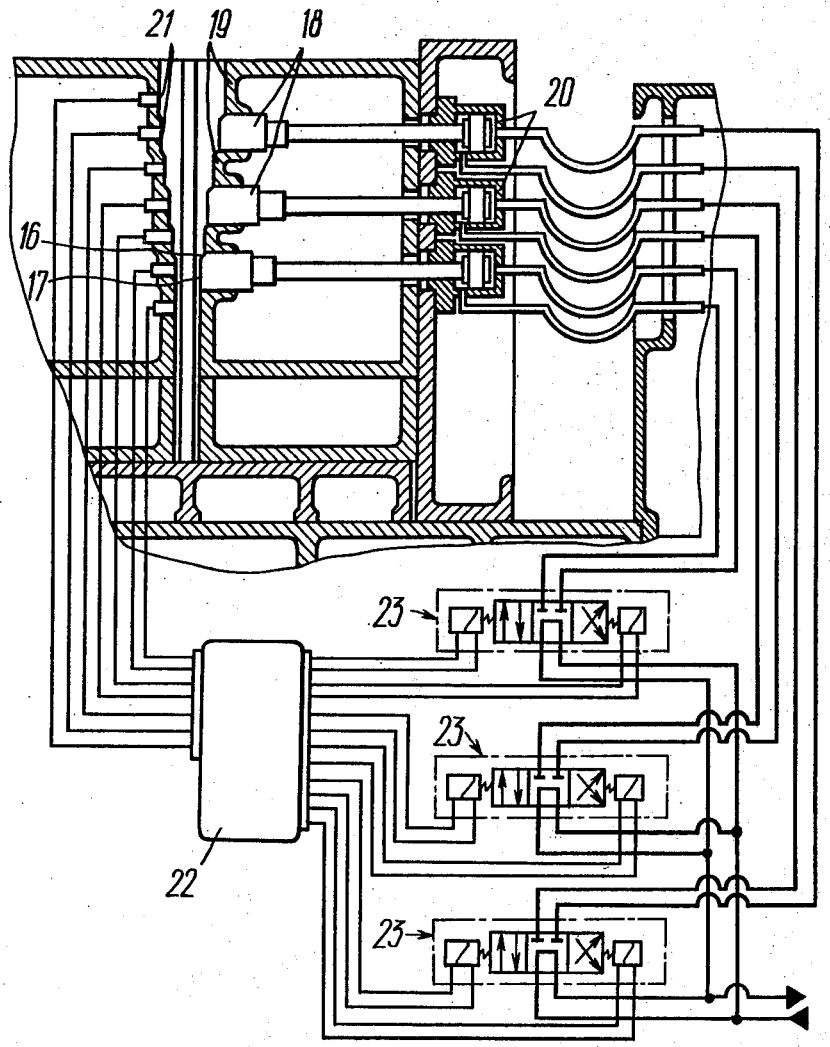
FIG. 10 is a partly diagrammatic and partly sectional (over a vertical plane) view of the casting mold embodiment of FIGS. 1 and 9 wherein the surfaces of slit gate space include moving parts in their step-shaped side surface, provided with individual drives, and means for controlling said drives.

Let us now consider FIGS. 9 and 10 illustrating still another embodiment of the casting mold according to the present invention. As distinct from the last-described embodiment, said latter embodiment of the mold is characterized by the fact that the step-shaped surface of the slit gate space is made up by a plurality of individual moving and stationary parts 18 and 19, respectively, each having a step 16 and a ledge 17. The stationary and moving parts alternate successively. The moving parts 18 are capable of moving perpendicularly to the plane of split by means of individual drives 20 coupled therewith. Built in the side surface 15 of the slit gate space 13 at the level of positioning of the ledges 17 of the part 18 are gauges 21 recording the presence of metal at this level. The gauges 21 are coupled with a comparison unit 22 ensuring, in the presence of error signal, the control over the drives 20 of the moving parts 18. In case a hydraulic drive is used for the displacement of the moving parts 18, the comparison unit 22 may be coupled, for example, with electromagnets of a slide valve means 23 of the drive supply network.

The operation of molds of FIGS. 9 and 10, according to the invention, differs from that described above in that at the moment when the metal surface passes through an appropriate level in the casting mold cavity it is determined by the metal level gauge 21. Such a gauge featuring a low delay may be provided, for example, by a contact pickup. A signal from the gauge 21 is transmitted to the comparison unit 22 in which information is stored on the optimum value of metal level in the mold that should correspond to a given movement of the half molds 8. If the signal of the gauge 21 coincides with the control signal of the program, the displacement drive 20 of the moving parts 18 is locked in position when the boundary portion of the surfaces of the ledges 17 and steps 16 provided on said parts coincides with the respective portions of the stationary parts 19 contacting with said former parts. If the signal of the gauge 21 is ahead or delayed, the comparison unit 22 shapes an error signal depending on the value and direction the displacement drive 20 of the part 18 provided either for the introduction of said part 18 in the body of the half mold 8, thereby increasing the cross-sectional area of the slit gate, or for the removal of said part 18 outside of the step-shaped surface 15' and into the space 13 of the slit gate thereby reducing the cross-sectional area of the latter.

Therefore, the afore-considered embodiment of casting mold hels impart an active form to the process of adjusting the rate of metal level rise and provide conditions for operation in the automatic mode with self-adjustment by means for adjusting the rate of metal level rise in the course of forming a casting. Such an embodiment of the invention provides for a high stability of the operating mode of forming the portion of the casting which presents the cast blank proper and, as a result, helps attain a stable and high quality of cast metal in the blank over the entire length thereof and in different blanks. This is especially advantageous when casting long-sized blanks for very critical parts, with a finished thin wall in the machines and for casting by squeezing with both plane-parallel and angular drawing together of half molds.

The use of the herein disclosed casting mold helps increase the yield of acceptable castings by ensuring a highly stable improved quality of cast metal.

Preferred embodiments of the present invention have been described hereinabove, however, it is to be understood by those skilled in the art that various changes and modifications can be made in said embodiments without departing from the spirit and scope of the present invention.

We claim:

1. A casting mold for casting by squeezing, fashioned as a split mold and comprising a set of half molds movably mounted on a base to define a split mold cavity having a parting plane upon drawing said half molds together and to subsequently split said mold upon drawing said half molds apart, said half molds defining a central cavity for forming an outer surface of a casting and defining peripheral spaces located along the parting plane of said mold, said peripheral spaces define slit gates when the half molds are together, said slit gates communicating with said central cavity by a channel defined by the set of half molds; the improvement residing in that at least one of said half molds defining the peripheral space has side surfaces defining said peripheral space having a step-shape when viewed from a direction transverse to said parting plane to aid in improving the accuracy in correcting the speed at which the level of molten metal in the central cavity is raised upon the drawing together of the half molds during the casting process.

2. A casting mold as set forth in claim 1, wherein all of the side surfaces defining the peripheral spaces of the half molds are step-shaped, with ledges of said step-shaped surfaces being arranged symmetrically to each other relative to the parting plane.

3. A casting mold as set forth in claim 1, wherein ledges of said step-shaped surfaces are located in a region in which the cross-section of the central cavity varies.

4. A casting mold as set forth in claim 3, wherein said step-shaped surfaces are inclined.

5. A casting mold as set forth in claim 1, wherein the step-shaped space is formed by a plurality of stationary parts, each in the form of a ledge and a step, and a plurality of movable parts in the form of a ledge and a step, alternating with said stationary parts, said movable parts mounted for moving perpendicularly to the parting plane.

6. A casting mold as set forth in claim 5, wherein each moving part has an individual drive.

7. A casting mold as set forth in claim 6, including metal level gauges located in the parting plane near a plane of a ledge of a movable step-shaped part, said gauge being coupled to the drive of the respective movable part for moving the latter along a line normal to the parting plane.

* * * * *